United States Patent [19]

Beaudry

[11] Patent Number: 5,006,832

[45] Date of Patent: Apr. 9, 1991

[54] POCKET ALARM

[76] Inventor: Armand J. Beaudry, 11502 - 66 Street, Edmonton, Alberta, Canada, T5J 1H9

[21] Appl. No.: 521,550

[22] Filed: May 10, 1990

[51] Int. Cl.[5] ..... G08B 15/00

[52] U.S. Cl. ..... 340/574; 340/669; 340/573

[58] Field of Search ..... 340/574, 573, 669

[56] References Cited

U.S. PATENT DOCUMENTS

| | | | |
|---|---|---|---|
| 3,579,221 | 5/1971 | Ashley et al. | 340/539 |
| 3,634,885 | 1/1972 | Barkley | 340/573 |
| 3,725,890 | 4/1973 | Cirino | 340/669 |
| 4,110,741 | 8/1978 | Hubert et al. | 340/573 |
| 4,158,197 | 6/1979 | Takagaki | 340/574 |
| 4,262,285 | 4/1981 | Polley | 340/574 |
| 4,404,549 | 9/1983 | Berg | 340/574 |
| 4,479,114 | 10/1984 | Yamamoto | 340/669 |
| 4,520,351 | 5/1985 | Altman et al. | 340/574 |

FOREIGN PATENT DOCUMENTS

| | | |
|---|---|---|
| 867512 | 3/1971 | Canada . |
| 958098 | 11/1974 | Canada . |
| 1213335 | 10/1986 | Canada . |
| 1238386 | 6/1988 | Canada . |

*Primary Examiner*—Glen R. Swann, III

*Attorney, Agent, or Firm*—Anthony R. Lambert

[57] ABSTRACT

A portable alarm includes a light circuit having in series a normally closed first relay contact and a light, an alarm circuit having in series an impact switch and an alarm, a manual switch in series with each of the light circuit and the alarm circuit for activating the light circuit and setting the alarm circuit to a ready position, the impact switch being operable upon impact to turn the alarm on when the alarm circuit is in the ready position, an alarm maintenance circuit connected in series with the alarm circuit, a relay in series with the impact switch, the relay being operable to open the normally closed first relay contact and to activate the alarm maintenance circuit, and a power source for the light, alarm and alarm maintenance circuits.

Once the portable alarm is set to the ready position a light goes on. A severe jolt to the pocket alarm and thus the impact switch turns the light off and activates an alarm. The alarm can only be switched off by using a recessed switch.

11 Claims, 2 Drawing Sheets

POCKET ALARM

FIELD OF INVENTION

This invention relates to portable or pocket alarms that may be carried by a person.

BACKGROUND OF THE INvENTION

Various alarms have been developed, some of which include movement sensitive devices, but none show a device switch to turn off the alert light and to turn on an alarm.

Altman et al, U.S. Pat. No. 4,520,351, issued May 28, 1985 shows a manual deadman switch which sets an alarm, the alarm being delayed for a pre-set period of time after the manual deadman switch is operated. The deadman switch can be deactivated only by coded switches. Although Altman shows a light for indicating when the battery is working, and the coded switch being in a closed position, the light is also operated by the deadman switch. To operate the Altman device, both the manual deadman switch and the coded switch need to be manipulated before the alert light comes on. For the proper operation of the Altman, the deadman switch must be held down by the operator. This is inconvenient for the operator, and results in a more complex system than is shown in the present invention, in which an alert state is also includes a delay before the alarm goes on, after release of the deadman switch, to prevent spurious alarms, this increases the complexity of the Altman device:

In addition, the Altman device includes a complex coded switch which needs to be manipulated both the set the alarm in the alert state, and to turn the alarm off if the alarm is activated. Such a switch is difficult to manipulate.

Demuth, Canadian Patent 867,512, issued Mar. 30, 1971, shows a position sensitive alarm, which sets off an alarm when a persons body is in other than normal position. It also includes a radio transmitter and receiver, and a display, for indicating the location of the person. No light is shown.

Yannuzzi, Canadian Patent 958,098, issued Nov. 19, 1974, shows a medical alert device which includes a position sensitive switch and an audible alarm, together with a manual override. No light is shown, and no related manual switch is shown.

Clendening, Canadian Patent 1,213,335, issued Oct. 28, 1986, shows an alarm which is attached to a belt having a lock. Once the alarm is set off, it cannot be turned off until the belt is removed.

Schwartz, Canadian Patent 1,238,386, issued June 21, 1988, shows a position sensitive switch of a particular type, having mercury in a frusco- conical well and does not show an alert light.

Ashley et al, U.S. Pat. No. 3,579,221, issued May 18, 1971, shows a deadman switch, together with an alarm, in conjunction with a radio detection and location device.

Barkley, U.S. Pat. No. 3,634,885, issued Jan. 11, 1972, shows a medical alert device, in which a position sensing switch (a mercury filled attitude switch) operates an audible message alarm, containing medical information on a patient. There is also shown an override switch and a backup switch.

Hubert, et al, U.S. Pat. No. 4,110,741, issued Aug. 29, 1978 shows a movement monitor. If movement ceases, for a pre-set period of time, an alarm is activated.

Polley, U.S. Pat. No. 4,262,285, issued Apr. 14, 1981, shows a spring biased rod normally held closed by a cap or person's hand. When released, it activates an alarm with a pin mechanism such that the alarm cannot be deactivated.

Berg, U.S. Pat. No. 4,404,549, issued Sept. 13, 1983, shoWs a manual switch to set off an alarm, which requires a key switch to turn off the alarm.

Bussing, U.S. Pat. No. 4,692,749, issued Sept. 8, 1987, and Takagaki, U.S. Pat. No. 4,158,197, issued June 12, 1979, show a personal distress alarm in which in individual must activate a switch or part of the alarm device to initiate an alarm.

None of the prior art patents show all of the features in the present invention, and none shows a device with a single switch to set the alert light, and a single impact switch to set off the alert light and turn on an alarm.

SUMMARY OF THE INVENTION

The inventor has provided a novel pocket alarm which provides an improvement over the prior art patents, and in one broad embodiment comprises a light circuit having in series a normally closed first relay contact and a light, an alarm circuit having in series an impact switch and an alarm, manual switch means in series with each of the light circuit and the alarm circuit for activating the light circuit and setting the alarm circuit to a ready position, the impact switch being operable upon impact to turn the alarm on when the alarm circuit is in the ready position, an alarm maintenance circuit connected in series with the alarm circuit, a relay in series with the impact switch, the relay being operable to open the normally closed first relay contact and to activate the alarm maintenance circuits, and a power source for the light, alarm and alarm maintenance circuits.

In a further embodiment, the alarm maintenance circuit includes a normally opened second relay contact connected across the manual switch and the impact switch, the relay being operable to close the second relay contact.

In a still further embodiment, the impact switch comprises a switch housing, a conductive cantilever spring connected to the housing and having a free end, a conductive sleeve connected to the housing, the free end being disposed within the conductive sleeve and being electrically conducting and having a mass in relation to the conductive cantilever spring such that the free end is movable between and so far as to touch the conductive sleeve upon rapid movement of the switch housing.

In other embodiments of the invention, the invention further includes an impact switch having a pair of opposing faces, the housing being cylindrical, a recessed override off switch, and a cylindrical housing having bevelled ends.

BRIEF DESCRIPTION OF THE FIGURES

There will now be described a preferred embodiment of the invention, with reference to the figures by way of illustration only, in which like numerals denote like figures and in which.

DETAILED DESCRIPTION OF THE PREFERRED EMBODIMENTS

Figure 1A:
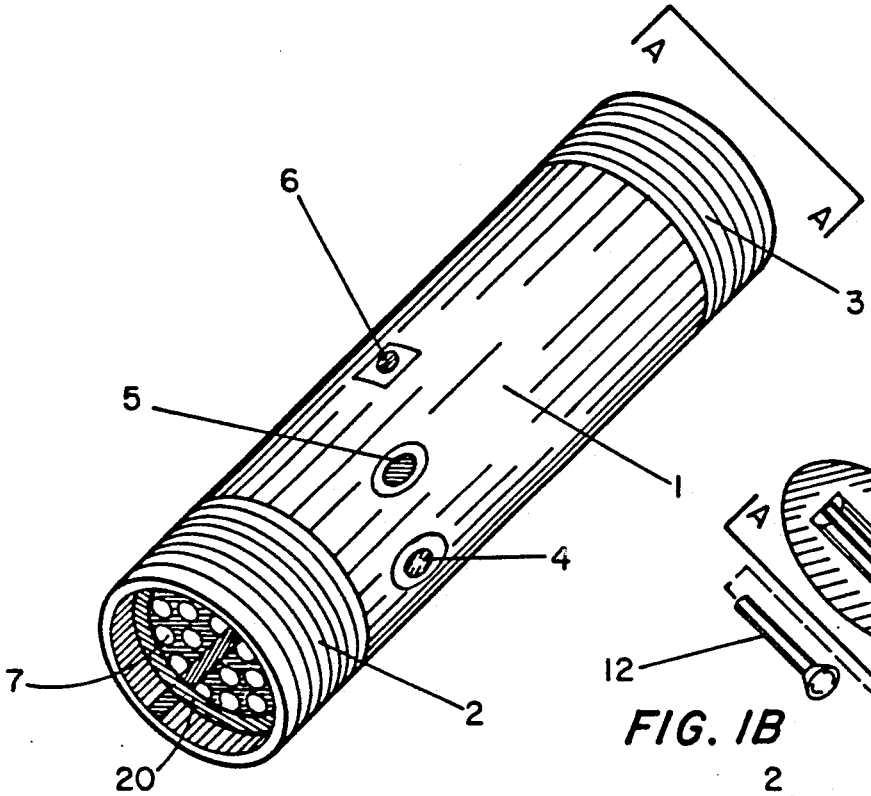
FIG. 1A is an isometric view of a pocket alarm according to the invention.

Referring to FIG. 1A, there is shown a pocket alarm according to the invention being defined by a main case 1 made of any high strength material such as cast aluminum, or high tensile plastic tubing. The casing is preferably cylindrical which allows the alarm to roll upon impact with the ground. This helps prevent an attacker from finding the alarm.

The pocket alarm casing 1 is provided with a short circular sleeve section 2 at one end which houses an alarm 7. The alarm 7 can be any suitable, preferably high pitched alarm, commonly known in the art, such as Archer model No. 273-072. The end of the circular sleeve section 2 includes a perforated end so that sound waves can readily exit the pocket alarm.

The sleeve section 2 includes strips 20 which provide a bevelled end for the alarm.

The pocket alarm is provided with a rear cap 3, also of cylindrical shape, and made of the same material. The rear cap 3 is removable for access to a battery 9 (not shown in FIG. 1A, but shown in FIG. 2). The battery 9 is preferably a standard 9 v battery. The rear cap 3 also provides for access to the impact contactor 8.

The rear cap 3 is also preferably bevelled to prevent the pocket alarm from landing and remaining upright.

Figure 1B:
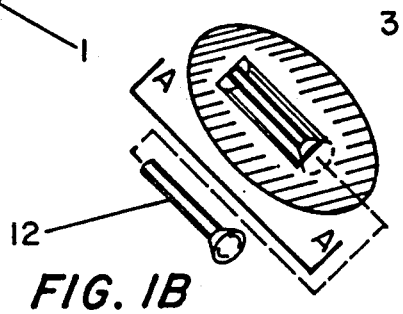
FIG. 1B is an end view of the embodiment of the invention shown in FIG. 1A.
Figure 2:
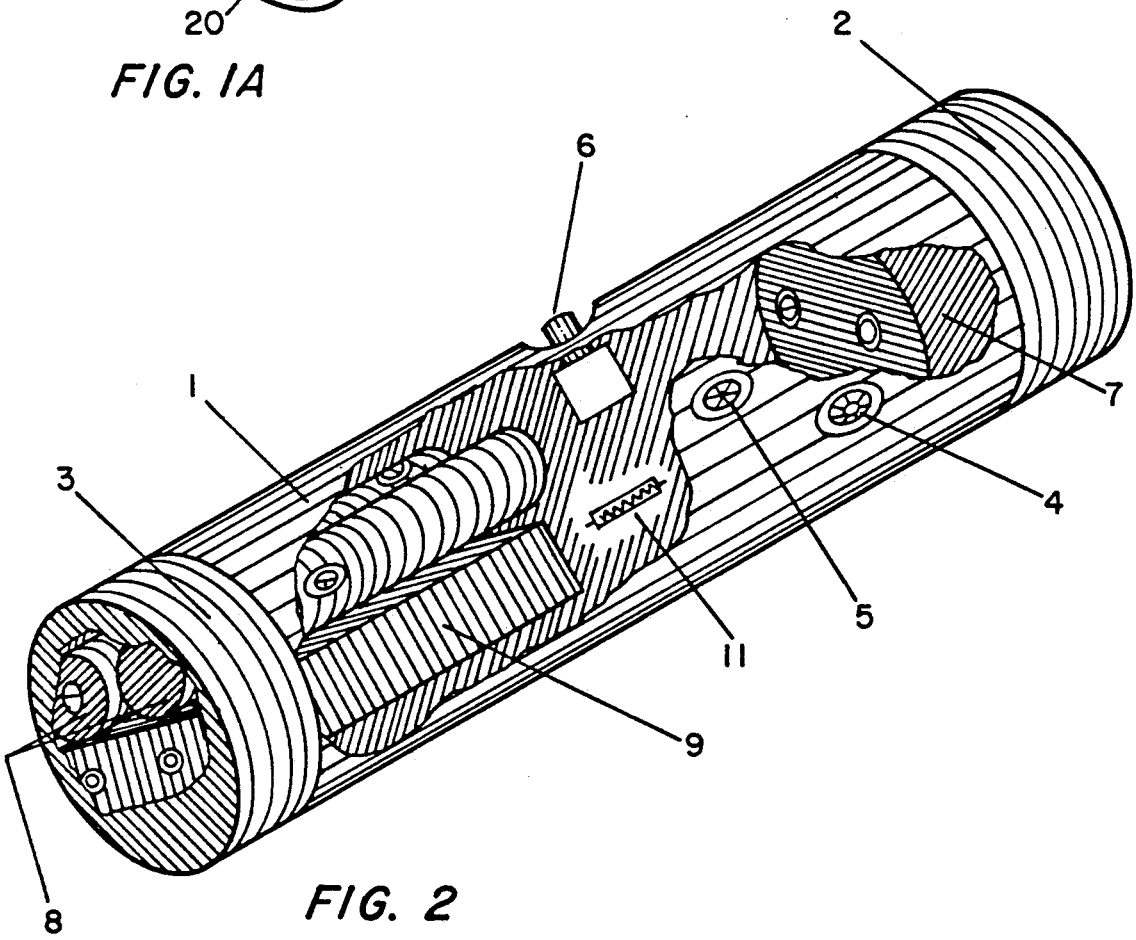
FIG. 2 is an isometric view of a pocket alarm according to the invention partially cut away.
Figure 3:
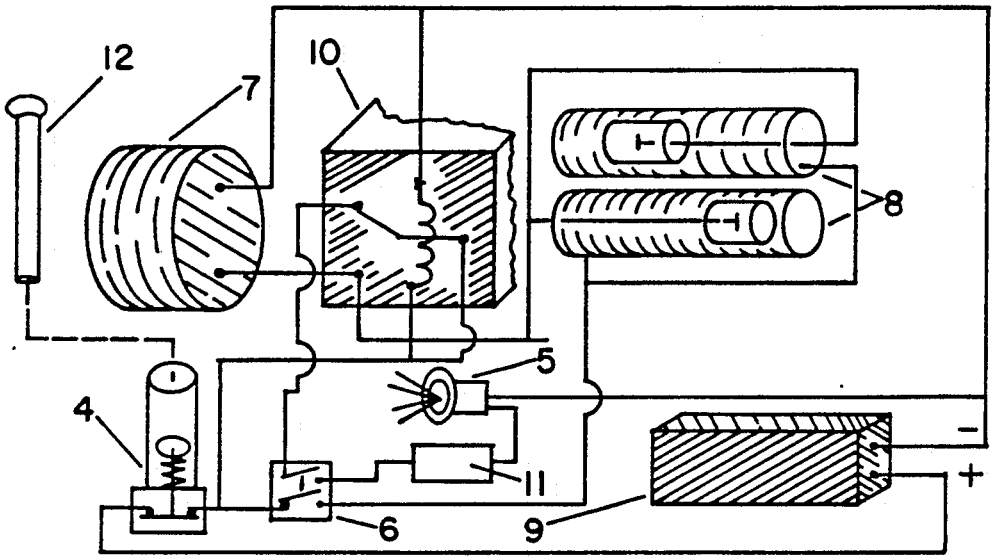
FIG. 3 is an electrical wiring diagram of the pocket alarm shown in FIGS. 1 and 2.

Referring to FIGS. 1A, 2 and 3, a recessed switch 4 is provided to stop the alarm when it is actuated, particularly during testing. The recessed switch 4 makes it difficult to turn the alarm off once the alarm is sounded. The switch is actuated by a pin 12 which may be stored in the end cap 3 as shown in FIG. 1B.

A small alert light, such as a LED illuminating diode 5 is provided to show when the alarm is in the ready or alert position. A small slide switch 6 is provided to place the alarm in the alert state and to turn on the light 5.

Figures 4A, 4B, 4C:
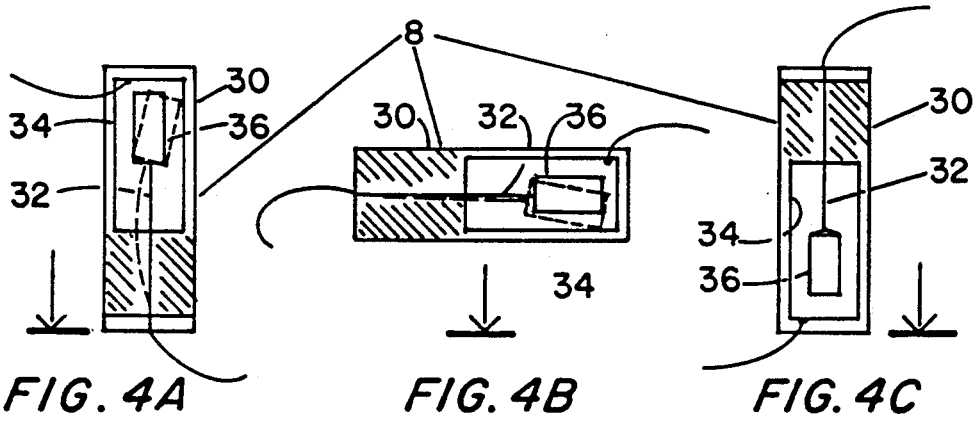
FIG. 4 shows three positions of an impact switch according to the invention.

An impact switch 8, shown in greater detail in FIG. 4, is provided so that on contact of the pocket alarm with the ground, the alarm 7 is activated. The impact switch 8 that is shown includes a pair of impact connectors oriented oppositely to each other to guarantee contact regardless of the position of the pocket alarm upon impact. The impact switch 8 includes a switch housing 30, a conductive cantilever spring 32 connected to the housing and having a free end 36 and a conductive sleeve 34 connected to the housing. The free end 36 is disposed within the conductive sleeve 34, is electrically conducting, and has a mass in relation to the conductive cantilever spring 32 such that the free end 36 is movable between and so far as to touch the conductive sleeve upon rapid movement of the switch housing. The conductive cantilever spring 32 may be for example a wire spring. With some loss of performance, the conductive cylindrical sleeve 34 could be replaced with a pair of opposing faces disposed in a switch housing.

Other configurations of the impact switch could be used, such as a circular loop surrounding an electrical conductor, so that the circular loop contacts the conductor upon rapid movement of the impact switch. In either case, the movement of the conductive spring contacts with another conductor to close a circuit and activate the alarm 7.

The left hand figure in FIG. 4 shows the switch on impact in the direction of the arrow pointing down. The wire spring 32 in the centre of the switch housing 30 bends to one side on switch impact, thereby making contact with the inner conductive (metallic) sleeve 34. An electrical circuit is then completed as can be seen in the wiring diagram FIG. 3 by activating the relay 10 (including relay contacts 22 and 24). Activation of the relay 10 closes the contact 24 and opens the contact 22 thereby taking the impact switch 8 out of the circuit. The relay 10 may be any suitable relay such as Archer model no. 275-243, but it will be understood by a person skilled in the art that here and in the claims the relay may be substituted by the electronic equivalent such as an electronic chip configured as a relay.

The impact switch 8 is shown in opposite vertical and horizontal positions. Two impact switches 8 are used in the preferred embodiment of the pocket alarm to guarantee contact no matter how the pocket alarm falls.

A resistor 11 is also provided to minimize power consumption when the pocket alarm is placed in the alert state. A variable resistor may be used to vary the intensity of the light emitted by the diode and may be any suitable resistor such as model no. 902/PK rated at 80 to 100 ohms. It is connected in series with the LED light 5.

Figure 5:
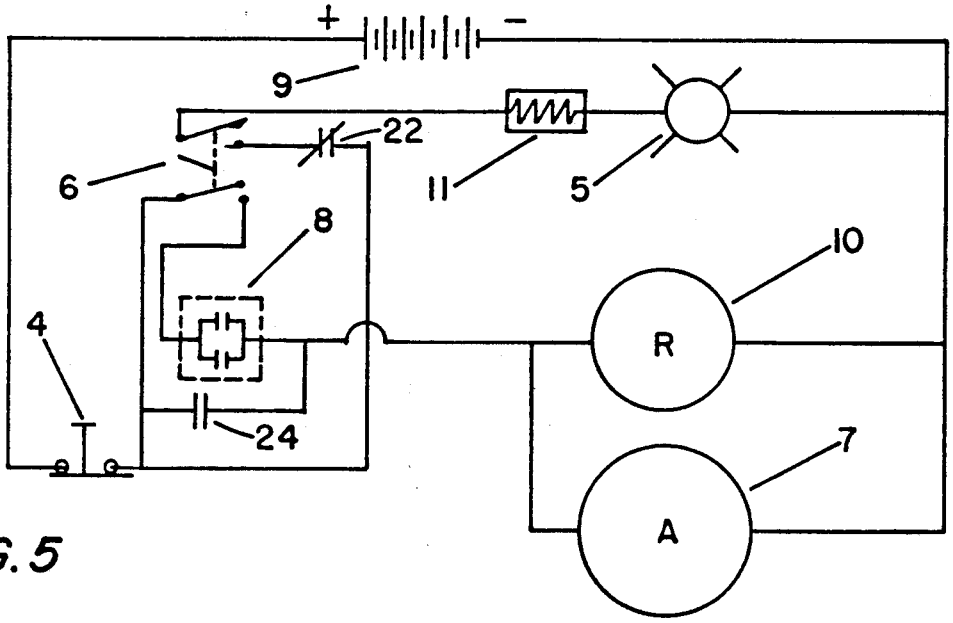
FIG. 5 is an electrical schematic of the embodiment shown in FIG. 3.

Referring to FIGS. 3 and 5, the electrical circuitry of the pocket alarm includes a light circuit having in series a normally closed first relay contact 22 and a light 5; an alarm circuit having in series an impact switch 8 and an alarm 7, manual switch means or slide switch 6 in series with each of the light circuit and the alarm circuit for activating the light circuit and setting the alarm circuit to a ready position, the impact switch 8 being operable upon impact to turn the alarm 7 on when the alarm circuit is in the ready position, an alarm maintenance circuit connected in series with the alarm circuit, a relay 10 in series with the impact switch 8, the relay 10 being operable to open a normally closed first relay contact 22 and to activate the alarm maintenance circuit, and a power source or battery 9 for the light, alarm and alarm maintenance circuits.

The alarm maintenance circuit includes a normally open second relay contact 24 activated by the relay 10, and which is connected across the manual slide switch 6 and the impact switch 8.

The operation of the pocket alarm is as follows. The pocket alarm may be carried in a person's pocket or purse. The person, he or she, is walking in a relatively dark area, the person carries the alarm unit in their hand and having set the unit to alert by pressing the alert switch. The small alert light 5 will emit a small red glow, assuring that the alarm is set to activate upon impact. Should the person be molested or attacked, the pocket alarm is dropped, and upon impact with the ground or surface under foot, it will set off a loud intermittent siren-like sound and will continue to do so until battery power has been exhausted. This can be up to four or five minutes depending on the battery charge at the time.

Since the alarm unit is of a cylindrical shape with rounded ends it will tend to roll away after impact and be difficult to locate since it is black in colour and the red alert light immediately goes off as the alarm goes on. Furthermore, should the attacker try to and succeed in stepping on the alarm unit, which is highly unlikely, the unit is constructed of such high tensile material that trying to destroy it by stepping on it would be of no avail.

If the attacker should in any way be able to pick up the alarm unit while still holding onto the victim, the attacker could not turn the alarm off by simply pushing the stop button, as the stop button is recessed in the alarm body and requires the use of a pin such as pin 12 held in one hand while holding the alarm unit in the other. Such action by the attacker would of course free the victim to run and call for help.

I claim:

1. A portable alarm comprising:

a light circuit having in series a normally closed first relay contact and a light;

an alarm circuit having in series an impact switch and an alarm;

manual switch means in series with each of the light circuit and the alarm circuit for activating the light circuit and setting the alarm circuit to a ready position, the impact switch being operable upon impact to turn the alarm on when the alarm circuit is in the ready position;

an alarm maintenance circuit connected in series with the alarm circuit;

a relay in series with the impact switch, the relay being operable to open the normally closed first relay contact and to activate the alarm maintenance circuit; and a power source for the light, alarm and alarm maintenance circuits.

2. The portable alarm of claim 1 in which the alarm maintenance circuit includes a normally open second relay contact connected across the manual switch and the impact switch, the relay being operable to close the second relay contact.

3. The portable alarm of claim 2 in which the impact switch comprises a switch housing, a pair of opposing faces disposed in the switch housing, a conducting spring connected to the housing and having a free end, the free end being disposed between the opposing conductive faces and having a mass such that the free end is movable between and so far as to touch the opposing conductive faces on rapid movement of the switch housing, and in which the housing of the portable alarm is cylindrical.

4. The portable alarm of claim 2 in which the impact switch comprises a switch housing, a pair of opposing faces disposed in the switch housing, a conducting spring connected to the housing and having a free end, the free end having disposed between the opposing conductive faces and having a mass such that the free end is movable between and so far as to touch the opposing conductive faces on rapid movement of the switch housing, and further comprising a recessed override off switch.

5. The portable alarm of claim 2 in which the impact switch comprises a switch housing, a pair of opposing faces disposed in the switch housing, a conducting spring connected to the housing and having a free end, the free end being disposed between the opposing conductive faces and having a mass such that the free end is movable between and so far as to touch the opposing conductive faces on rapid movement of the switch housing, in which the housing of the portable alarm is cylindrical, and further comprising a recessed override off switch.

6. The portable alarm of claim 1 in which the impact switch comprises a switch housing, a conductive cantilever spring connected to the housing and having a free end, a conductive sleeve connected to the housing, the free end being conducting and having a mass in relation to the conductive cantilever spring such that the free end is movable between and so far as to touch the conductive sleeve upon rapid movement of the switch housing.

7. The portable alarm of claim 1 in which the impact switch comprises a pair of switches, in which each of the switches includes a switch housing, a conductive sleeve connected to the housing, a wire spring connected to the housing and having a free end disposed within the conductive sleeve the free end being electrically conducting and having a mass in relation to the wire spring such that the free end is movable between and so far as to touch the conductive sleeve upon rapid movement of the switch housing, each of the pair of switches being oriented oppositely to the other.

8. The portable alarm of claim 1 in which the impact switch comprises a switch housing, a pair of opposing faces disposed in the switch housing, a conducting spring connected to the housing and having a free end, the free end being disposed between the conductive faces and having a mass such that the free end is movable between and so far as to touch the opposing conductive faces on rapid movement of the switch housing.

9. The portable alarm of claim 1 in which the housing is cylindrical.

10. The portable alarm of claim 1 further comprising a recessed override off switch.

11. The portable alarm of claim 1 in which the housing is cylindrical and further comprising a recessed override off switch.

* * * * *